United States Patent [19]

Sutliff et al.

[11] 4,173,130

[45] Nov. 6, 1979

[54] DRILLING SHOCK SUB

[76] Inventors: Wayne N. Sutliff; Jim L. Downen, both of 2931 Pierce Rd., Bakersfield, Calif. 93308

[21] Appl. No.: 874,035

[22] Filed: Jan. 31, 1978

[51] Int. Cl.[2] ..... F16D 3/06; F16F 9/30; F16F 9/06

[52] U.S. Cl. ..... 64/23; 175/321; 188/268; 188/269

[58] Field of Search ..... 64/23; 175/321; 188/268, 269; 285/89, 175, 355

[56] References Cited

U.S. PATENT DOCUMENTS

| | | | |
|---|---|---|---|
| 2,240,519 | 5/1941 | Reed | 175/321 |
| 2,678,806 | 5/1954 | Brown | 175/321 |
| 3,285,596 | 11/1966 | Burgert | 188/268 |
| 3,323,327 | 6/1967 | Leathers | 64/23 |
| 3,353,613 | 11/1967 | Harrison | 64/23 |
| 3,383,126 | 5/1968 | Salvatori | 64/23 |
| 3,424,448 | 1/1969 | Ma | 188/268 |
| 3,504,936 | 4/1970 | Brown | 175/321 |
| 3,660,990 | 5/1972 | Zerb | 175/321 |

*Primary Examiner*—Charles J. Myhre
*Assistant Examiner*—R. C. Turner
*Attorney, Agent, or Firm*—Dana E. Keech; Dana E. Keech

[57] ABSTRACT

A drill string protecting axial shock absorbing sub which is relatively short and rugged and comprises inner and outer telescopically intersplined tubular elements forming therebetween an annular shock absorbing cushion confining piston chamber which is filled with a tightly packed suspension of ⅜" polyurethane pellets in a highly heat resistant lubricant such as "Mobil #1 Synthesized Engine Lubricant".

1 Claim, 10 Drawing Figures

DRILLING SHOCK SUB

SUMMARY OF THE INVENTION

The common practice when drilling a deep well is to cushion the drill string from the drill bit by suspending the bit from said string through an assembled series of special tools which are identified in the art, starting at the bottom, as (a) a shock sub, (b) one or more drill collars, (c) one or more jars, (d) further drill collars, and (e) at least one bumper sub.

This drilling tool assembly performs a number of special functions but, in toto, it provides the measure of weight desireably applicable uniformly to the bit throughout the drilling operation. For its special part, the function assigned to the shock sub is to stand ready to protect the drill string from damaging shocks incidental to any of the unpredictable sudden strains imposed on the bit, particularly as in very deep drilling operations.

While the prior art displays numerous advances in the designing of shock subs, the prime object of the present invention is to provide a novel tool in this category having a unique shock cushioning mechanism exceeding its predecessors in economy, rugged durability and ease in servicing.

Another object of the present invention is to provide in a shock sub a highly efficient semi-hydraulic mechanism which is especially designed to withstand the tendencies of shock subs to come unscrewed and thus inoperative under the terrific vibration stresses to which this type of tool is subjected by its direct attachment to the drill bit itself.

Figure 1:
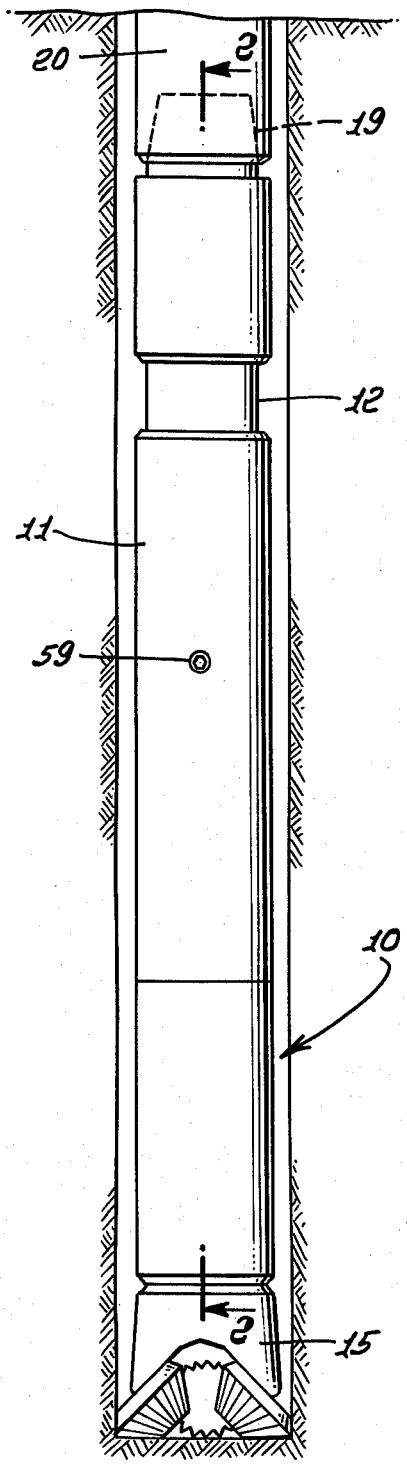
FIG. 1 is a diagrammatic elevational view of a preferred embodiment of the invention.

FIGS. *2a, 2b* and *2c* comprise an enlarged continuous left hand sectional series of views taken sequentially from top-downward on line 2—2 of FIG. 1 and showing the invention in its state of maximum extension.

FIGS. *3a, 3b* and *3c* comprise a similar series of sectional views taken on the same line of FIG. 1 but showing the tool axially partly compressed as when absorbing a heavy compressive shock from the bit.

Figure 4:
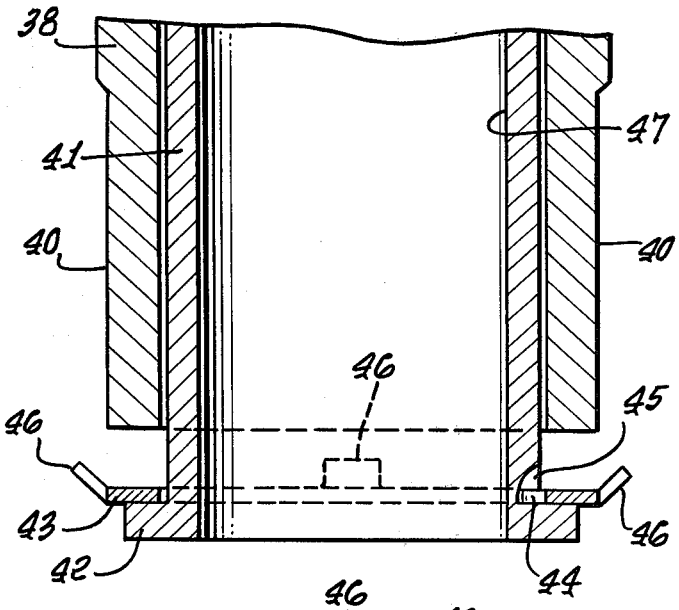

FIG. 4 is a detail vertical cross sectional view of the inner and outer wash pipes of the invention taken on the line 2—2 of FIG. 1 and illustrates an intermediate step in the assembly of said wash pipes.

Figure 5:
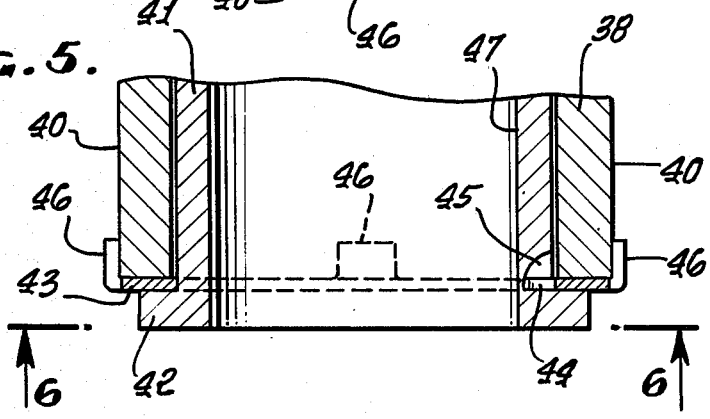
Figure 2A:
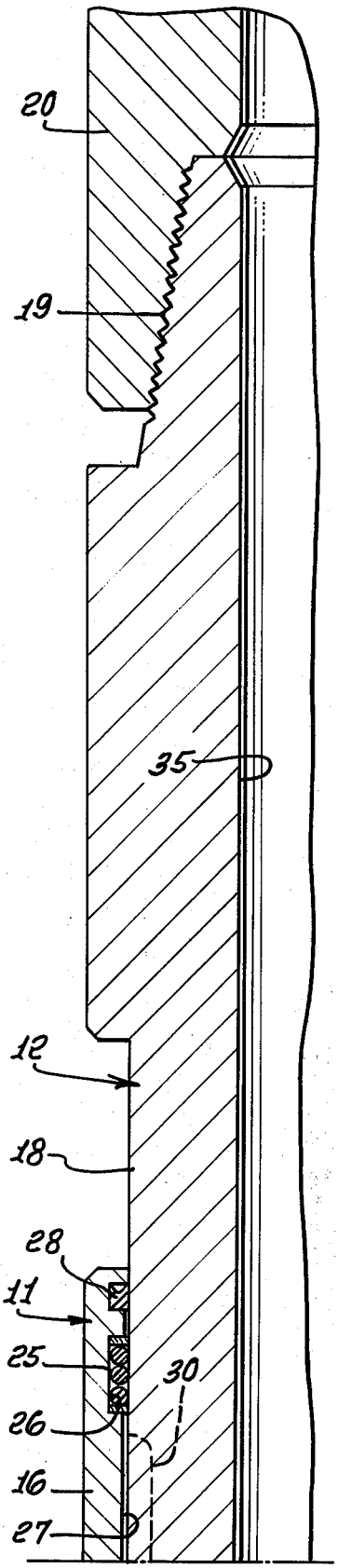
Figure 2B:
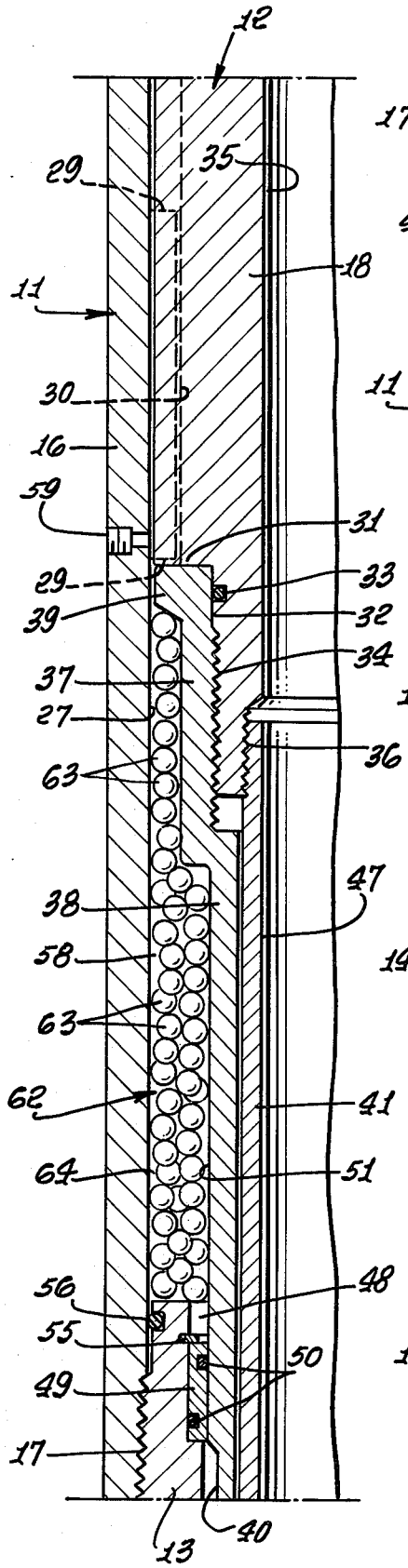
Figure 2C:
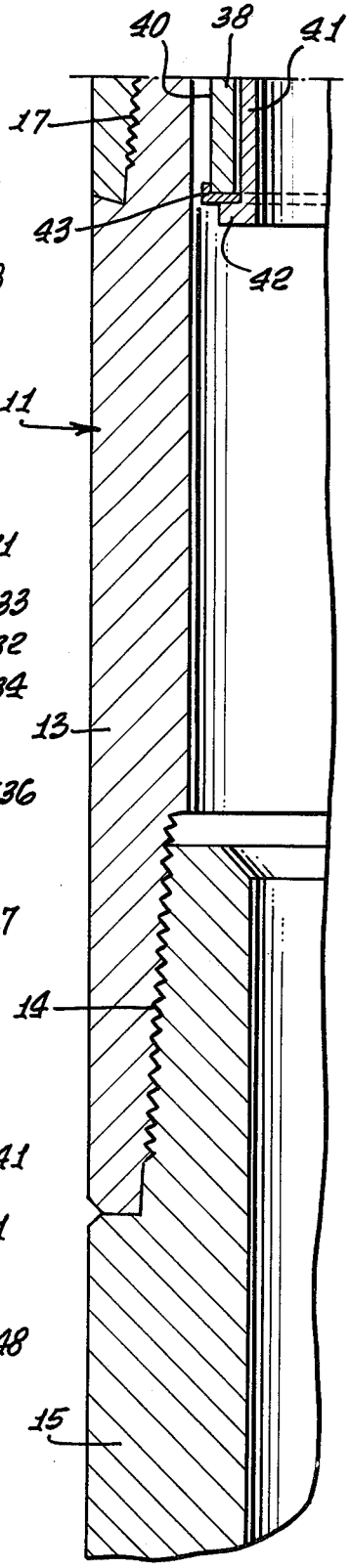
Figure 3A:
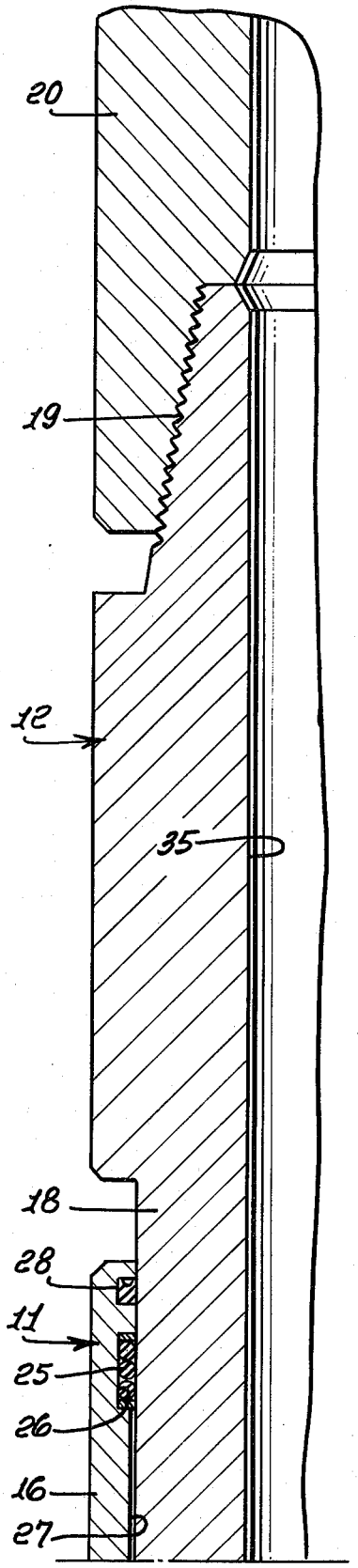
Figure 3B:
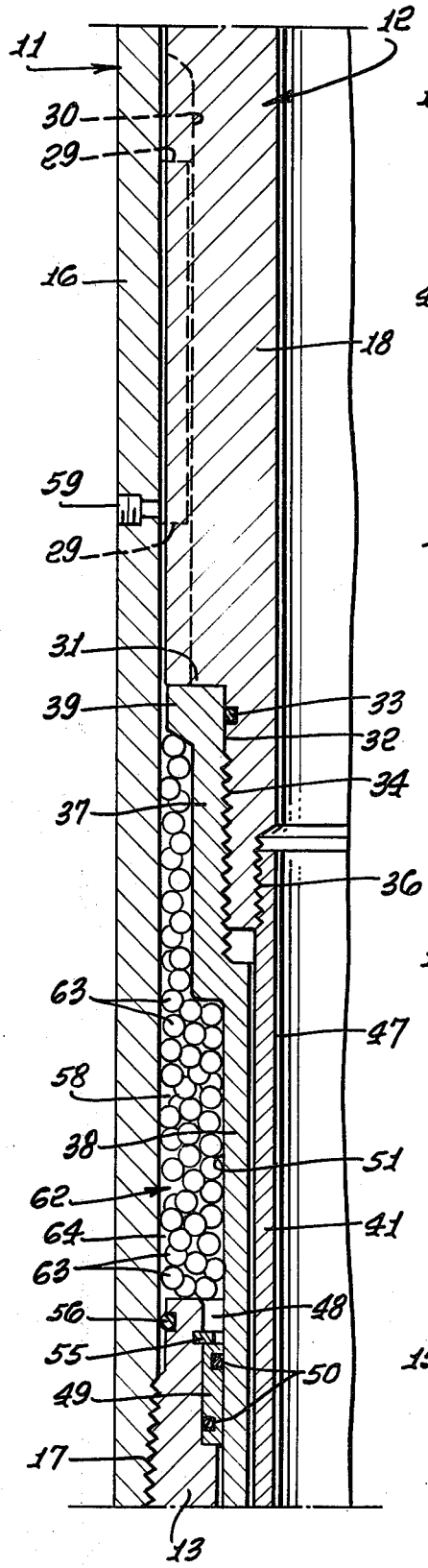
Figure 3C:
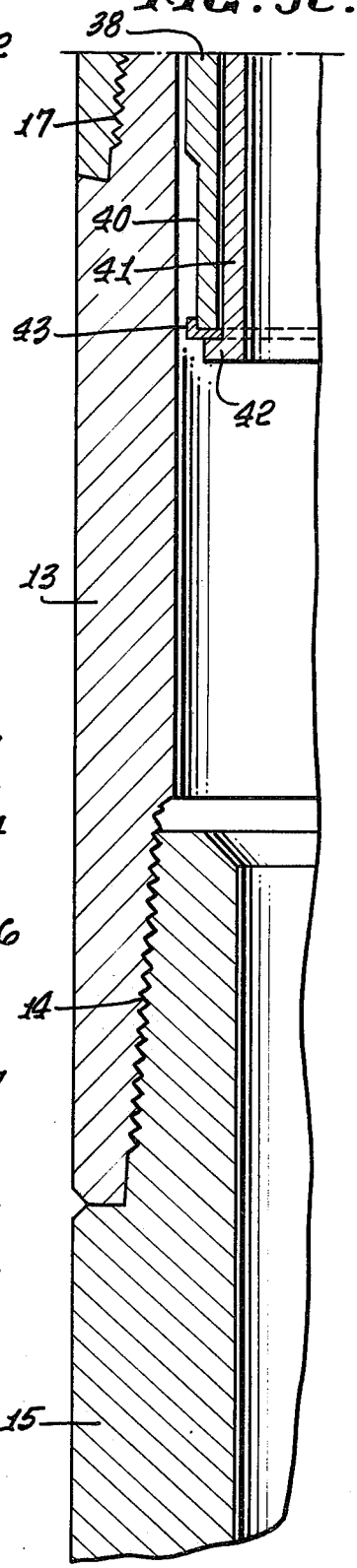

FIG. 5 is a similar cross sectional view illustrating the completion of said assembly.

Figure 6:
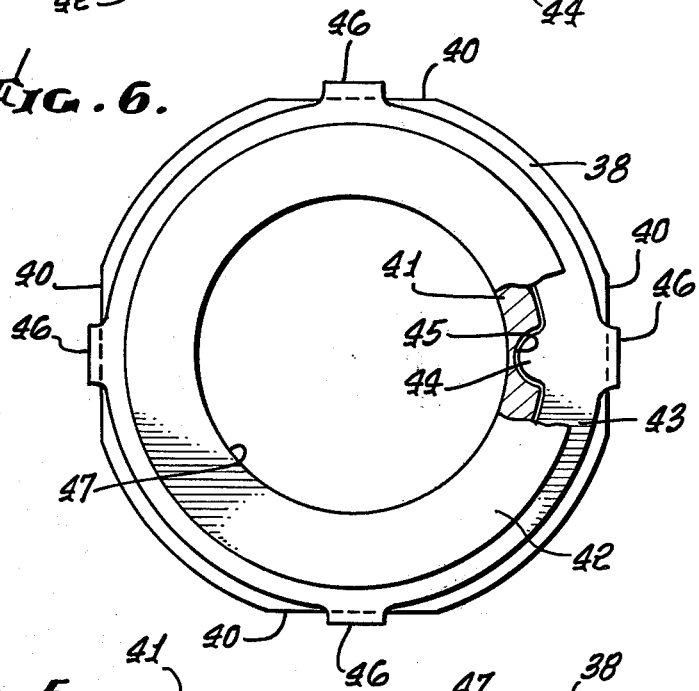

FIG. 6 is a bottom plan view of said assembled wash pipes taken on line 6—6 of FIG. 5, and looking upwardly.

DETAILED DESCRIPTION OF THE PREFERRED EMBODIMENT

Referring specifically to the drawings and particularly to FIGS. 1, *2a, 2b* and *2c*, the invention is there illustrated as comprising a well drill string shock sub 10 which includes outer and inner tubular elements 11 and 12 which are telescopically slideably related in the performance of their respective functions.

The outer tubular element 11 has at its lower end a relatively thick walled lower portion 13 which connects sub 10 through tapered threads 14 to a drill bit 15. Element 11 also includes a relatively thin-walled upper portion or sleeve 16 which has a common external diameter with said lower portion 13 and is counter sunk into the latter and screwed thereto by threads 17.

The inner tubular element 12 has at its upper end a relatively thick walled upper portion 18 which connects sub 10 through tapered threads 19 with the lower end of a drill string assembly 20.

The thick walled inner element portion 18 slideably fits within and has tight sealing engagement with an annular upper shock sub packer 25 which preferably comprises a plurality of O-rings occupying an internal annular recess 26 provided just within the upper end of the bore 27 of thin walled portion 16 of outer tubular element 11.

An annular wiper 28, also recessed into the bore 27 just above packer 25, protects the latter from contamination by contact with ambient well liquids.

Thin walled outer tubular element portion 16 has eight short female splines 29 extending internally from the bore 27 thereof into splined interconnection with an equal number of considerably longer male splines 30 which radiate externally from thick walled upper portion 18 of tubular element 12.

The lower end of thick walled upper portion 18 of inner tubular element 12 is turned down externally to form an axial shoulder 31 at which the lower ends of male splines 30 terminate and to form a smooth neck 32 peripherally slotted to receive an O-ring 33 below which said neck is provided with right hand male threads 34. Thick walled inner tubular element portion 18 has the lower end of its bore 35 enlarged to form a left hand threaded counter bore 36.

Machined to screw tightly onto the right hand threads 34 on neck 32 and be sealed off by O-ring 33 is the belled annular head 37 provided integrally on the top end of a thin walled lower portion 38 of inner tubular element 12, this being hereinafter referred to as the outer wash pipe of shock sub 10.

The upper end of head 37 is heavily beaded and is screwed tightly against annular axial shoulder 31 to form a rugged limit stop 39 to the downward travel of female splines 29 between the male splines 30, the bottom limit of such travel being shown in FIG. *2b*.

The lower end of outer wash pipe 38 is squared externally at 40 for applying a socket wrench thereto to screw it in place with the requisite tightness.

A locking pipe 41, referred to hereinafter as an inner wash pipe, has left-handed male threads at its upper end for screwing it tightly into the left hand threaded counter bore 36. Inner wash pipe 41, however, has at its lower end an external flange 42 which underlies outer wash pipe 38 and supports a tang washer 43 from which an inner tang 44 is driven into a pocket 45 milled into the lower portion of inner wash pipe 41. Plural tangs 46 extend externally from washer 43. When the locking pipe 41 has been turned counterclockwise to clamp the washer 43 tightly between flange 42 and outer wash pipe 38, the external tangs 46 are bent flat upward against the square faces 40 provided on outer wash pipe 38 thereby locking the inner and outer wash pipes in rigidly assembled relation as shown in FIGS. 5 and 6.

The inner bore 47 of inner wash pipe 41 is selected to be identical with bore 35 of the balance of inner tubular element 12.

Lodged in an internal annular recess 48 formed in the upper end of thick walled portion 13 of tubular element 11 is a lower annular shock sub packer 49 comprising a metal ring recessed exteriorly and interiorly to receive O-rings 50, this packer sealing off the space between portion 13 and the outer surface 51 of outer wash pipe 38. Packer 49 is held in place in annular recess 48 by a snap ring 55 recessed in an annular slot provided in the lower portion 13 of tubular element 11.

Access to chamber 58 for introducing oil thereinto and allowing the escape of air is had through a plug 59 which is screwed into a tapped hole in sleeve 16.

Confined in the annular chamber 58 is a complex fluid elastic cushion 62. This cushion includes two elastic phases, a dispersed phase 63 thereof being formed of pelletized urethane and a continuous liquid phase 64 thereof which surrounds, suspends and supplements the cushioning action provided by the dispersed phase. The pelletized urethane 63 preferably comprises molded balls of this material with a durometer hardness of the order of 70–90 and with a diameter of the order of ⅜" to ½". The pelletizing of the urethane may also be accomplished by sawing off sections of urethane molded in rod form each of the sections thus formed being approximately equal in length to the diameter of the rod.

OPERATION

In preparing the drilling shock sub 10 of the invention for incorporation downwardly with a bit 15 and upwardly with a drill string 20, the sub 10 is temporarily inverted, the threads 17 are unscrewed and the main lower packer 56 as well as the supplementary lower packer 49 are withdrawn from chamber 58. With the sub 10 thus inverted and open upwardly, the chamber 58 is positioned for delivery into this of the annular cushion 62 of the tool. The dispersed phase 63 of this cushion, comprising pelletized urethane, is first poured into chamber 58 so as to snugly fill the space within said chamber up to a level still providing room for the packers 56 and 49 which are now reinserted into what will subsequently be the bottom end portion of chamber 58 when the sub 10 is reinverted for use. With the sub 10 so reinverted and the packers 56 and 49 returned to their positions in the lower end of the chamber 58, the lower portion 13 of outer tubular element 11 is reassembled with the balance of the sub as shown in FIGS. *2a, 2b* and *2c*. The sub 10 is now inclined at a slight upward angle with the oil plug 59 disposed upwardly, this plug being then removed and the continuous phase 64 of the cushion 62 which comprises engine lubricating oil is poured into the upper end of chamber 58 so as to completely fill all empty spaces in said chamber with said oil. When the chamber 58 has thus been completely filled by the annular cushion 62 of the sub 10, the plug 59 is tightly replaced in the sub. The sub 10 is now ready to be assembled with a drill bit 15 and a drill string 20 and run into a well for a drilling operation.

In a normal drilling operation the shock cushion 62 of the sub 10 absorbs the vibrations suffered by the drill 15 incidental to its engagement with various hard stratus of earth formation in much a similar manner that an automobile air and spring shock absorber absorbs vibrations imposed upon the undercarriage of an automobile by road travel. The annular shock cushion 62 however, is designed not only for this normal cushioning of minor vibrations generated in the bit 15 but is designed to absorb the much more serious shocks such as illustrated in the operation of the shock sub 10 by FIGS. *3a, 3b* and *3c*. The result of shock sub 10 absorbing such a major shock is well illustrated by FIG. *3b* which shows the very considerable extent to which annular cushion chamber 58 has been contracted and the cushion 62 thereby compressed in the process of absorbing said shock.

The shock sub 10 is designed to anticipate the shock absorbing requirements of this tool so that rarely, if ever, does a shock occur in the operation of the sub that has sufficient violence to completely collapse the cushion 62 of the shock sub 10. In other words, it is designed to always have marginal capacity for further contraction when the maximum demand for shock absorption has been met and satisfied.

We claim:

1. In a well drill string shock sub, the combination of:
   - inner and outer axially telescopically related tubular elements;
   - spline means transmitting torque between said elements;
   - means for connecting one of said elements to a drill bit;
   - means for connecting the other of said elements to a drill string assembly;
   - at least one pair of opposed shoulders being provided on said elements to set a limit to expansive telescopic movement between said elements;
   - overlapping portions respectively of said elements being comparatively thin walled to provide an annular hydraulic cushion confining chamber closed by annular sliding seals at its opposite ends;
   - a semi-hydraulic elastically compressible cushion confined in and filling said chamber to produce normally the telescopic expansion of the tool to its maximum length, the dispersed phase of said cushion comprising a well packed body of polyurethane pellets the continuous phase of said cushion comprising a body of engine lubricating oil of the order of Mobil No. 1;
   - the thin walled overlappiing portion of said inner element referred to as the outer wash pipe being secured by right hand female threads to right hand male threads of an adjoining thick walled portion of said inner element, said thick walled portion of said inner element being counter bored at one end and at the same end thereof being provided with left hand female threads;
   - a left hand threaded inner wash pipe fitting within said counter bore and screwing into the female left hand threads thereof; and
   - tang washer means for interlocking outer ends of said outer and inner wash pipes to assure against either becoming accidentally unscrewed.

* * * * *